US007481045B2

(12) United States Patent
Fayard

(10) Patent No.: US 7,481,045 B2
(45) Date of Patent: Jan. 27, 2009

(54) METHOD FOR THE POST-INJECTION OF HYDROCARBON-, ALCOHOL- AND/OR REDUCING-AGENT-TYPE REGENERATION SOLUTION (E.G. DIESEL FUEL AND/OR UREA AND/OR AMMONIACAL SOLUTION) FOR THE REGENERATION OF DIESEL ENGINE EXHAUST GAS FILTRATION SYSTEMS

(76) Inventor: Jean-Claude Fayard, 44 ter rue Professeur Florence, F-69003 Lyon (FR)

( * ) Notice: Subject to any disclaimer, the term of this patent is extended or adjusted under 35 U.S.C. 154(b) by 0 days.

(21) Appl. No.: 10/543,740

(22) PCT Filed: Dec. 23, 2003

(86) PCT No.: PCT/FR03/50206

§ 371 (c)(1),
(2), (4) Date: Jul. 29, 2005

(87) PCT Pub. No.: WO2004/079168

PCT Pub. Date: Sep. 16, 2004

(65) Prior Publication Data

US 2006/0096274 A1 May 11, 2006

(30) Foreign Application Priority Data

Jan. 31, 2003 (FR) ..... 03 01123

(51) Int. Cl.
*F01N 3/00* (2006.01)

(52) U.S. Cl. ..... 60/295; 60/274; 60/286; 60/289; 60/297; 60/303

(58) Field of Classification Search ..... 60/274, 60/286, 288, 290, 289, 291, 293, 295, 297, 60/303, 311
See application file for complete search history.

(56) References Cited

U.S. PATENT DOCUMENTS

| | | | | |
|---|---|---|---|---|
| 4,372,111 | A | 2/1983 | Virk et al. | 60/274 |
| 4,541,239 | A | 9/1985 | Tokura et al. | 60/286 |
| 4,589,254 | A | 5/1986 | Kume et al. | 60/286 |
| 5,143,700 | A | 9/1992 | Anguil | 422/176 |
| 5,207,990 | A | 5/1993 | Sekiya et al. | 422/183 |
| 5,522,218 | A | 6/1996 | Lane et al. | 60/274 |

(Continued)

FOREIGN PATENT DOCUMENTS

| | | |
|---|---|---|
| EP | 0 761 286 | 3/1997 |

(Continued)

*Primary Examiner*—Binh Q. Tran
(74) *Attorney, Agent, or Firm*—James C. Lydon

(57) ABSTRACT

A post-injection method for the regeneration of a device used to filter diesel engine exhaust gases. The method includes injecting a fully-pulverized hydrocarbon-, alcohol- and/or reducing-agent-type regeneration solution upstream of the oxidation catalyst (14) to increase the exhaust gases' temperature upon detection of clogging of the filter with particles. A computer uses temperature (2) and pressure (3) sensors disposed upstream of the filtration device to control injection of the regeneration solution from an electromagnetic injector (9). The regeneration solution is directed through a capillary (12) into the exhaust pipe (1) at a point located at a good distance from the injector, upstream of the catalyst (5), in order to be finely pulverized by the air.

31 Claims, 4 Drawing Sheets

U.S. PATENT DOCUMENTS

| | | | | | |
|---|---|---|---|---|---|
| 5,701,735 | A | * | 12/1997 | Kawaguchi | 60/274 |
| 5,822,977 | A | * | 10/1998 | Fukuda et al. | 60/274 |
| 5,943,858 | A | * | 8/1999 | Hofmann et al. | 60/303 |
| 5,974,791 | A | * | 11/1999 | Hirota et al. | 60/276 |
| 6,021,639 | A | * | 2/2000 | Abe et al. | 60/297 |
| 6,023,930 | A | * | 2/2000 | Abe et al. | 60/311 |
| 6,032,461 | A | * | 3/2000 | Kinugasa et al. | 60/295 |
| 6,050,088 | A | * | 4/2000 | Brenner | 60/303 |
| 6,192,677 | B1 | * | 2/2001 | Tost | 60/286 |
| 6,526,746 | B1 | * | 3/2003 | Wu | 60/286 |

FOREIGN PATENT DOCUMENTS

| | | | | | |
|---|---|---|---|---|---|
| EP | 1 158 143 | | | 11/2001 | |
| GB | 1 598 099 | | | 9/1981 | |
| JP | 63-198717 | | | 8/1988 | |
| JP | 363198717 | A | * | 8/1988 | 60/286 |
| JP | 7-119444 | | | 5/1995 | |
| JP | 2000-170526 | | | 6/2000 | |

* cited by examiner

METHOD FOR THE POST-INJECTION OF HYDROCARBON-, ALCOHOL- AND/OR REDUCING-AGENT-TYPE REGENERATION SOLUTION (E.G. DIESEL FUEL AND/OR UREA AND/OR AMMONIACAL SOLUTION) FOR THE REGENERATION OF DIESEL ENGINE EXHAUST GAS FILTRATION SYSTEMS

The present invention relates in general to the field of particulate filters and, more particularly, to a method for the post-injection of a hydrocarbon-, alcohol- and/or reducing-agent-type regeneration liquid (e.g. diesel fuel and/or urea and/or ammoniacal solution) upstream of a diesel engine exhaust gas filtration device to regenerate this filter.

Moreover, the present invention further relates to the management of this injection device, of which the purpose is to inject a homogeneous mixture of air and hydrocarbon-, alcohol- and/or reducing-agent-type regeneration liquid (e.g. diesel fuel and/or urea and/or ammoniacal solution) on the oxidation catalyst upstream of the filtration system to increase the temperature of the exhaust gases, as for a combustion. A high temperature level is necessary to oxidize and burn the carbonaceous particles produced by the engine and retained on this filtration system, in order to prevent their accumulation, this final phase constituting the regeneration, the object of the method according to the invention.

In addition to the development of new engines with lower and lower fuel consumption, a special effort has been made for the development of new exhaust systems, designed to reduce the emission of unburnt pollutant gases and solid particulates. Thus automobile manufacturers have developed catalytic converters or catalysts, generally consisting of a stainless steel housing, a thermal insulation and a honeycomb support impregnated with precious metals such as platinum or rhodium. These catalysts make it possible to reduce, above all, the emissions of polycyclic hydrocarbons and CO, in a proportion of about 90%. However, they exert no action on emissions of solid particulates. Thus, particularly for diesel engines which produce numerous solid particulates, these catalysts provide no significant improvement in air quality.

Other techniques have been developed to limit the emission of pollutant particulates by vehicles. One such case is the particulate filter. This filter serves to reduce the total mass of particulates emitted by diesel engines by more than 90%.

However, the particulate filter requires regeneration in order to burn the particulates that have been trapped. The particulates are generally trapped by a filter cartridge forming part of the particulate filter. To withstand the high temperatures encountered, this cartridge may consist of a porous body of cordierite, quartz or silicon carbide, generally in a honeycomb structure to present a maximum filtration surface area.

The major difficulty of the operation of these particulate filters resides in the control of the phase of oxidation and combustion of the particulates retained by the filter cartridge. In fact, in urban driving conditions, the temperature reached by the exhaust gas is insufficient to cause their combustion and to significantly limit the clogging of the filter and hence its regeneration. Without chemical assistance, the carbonaceous particles produced by the combustion of diesel fuel in diesel engines only begins to oxidize significantly above 500° C. These temperatures are practically never reached in urban driving conditions.

It therefore appears necessary to resort to a chemical method to remove these particulates. Various techniques are used to obtain their combustion.

A first technique consists in arranging a catalyst upstream of the filter, to oxidize the nitric oxide (NO) present in the exhaust gases to nitrogen dioxide ($NO_2$), the latter having the property of catalyzing the combustion of the carbonaceous particles from 250° C. However, this method requires the use of a diesel fuel in which the sulfur content is lower than 50 ppm (parts per million), to preserve sufficient NO to $NO_2$ conversion efficiency.

This technique, called "Continuous Regenerating Trap" (C.R.T.) combines the effects of the particulate filter and the NO oxidation catalyst. To guarantee satisfactory operation of the filters, this system requires regular regeneration to limit the pressure drop across the filter while eliminating the risk of uncontrolled and exothermic regeneration.

In the opposite case, violent reactions occur, associated with the excessive concentration of carbonaceous particles clogging the filter. These reactions consist of the excessively rapid combustion of a large mass of particles, generally causing destruction of the filter by thermal shock, because of the very high temperatures reached locally.

Other techniques make use of organometallic additives added to the diesel fuel, such as cerium, iron, strontium, calcium or others. These techniques serve to obtain a similar effect to the one obtained with $NO_2$, by catalyzing the combustion of the carbonaceous materials at temperatures close to 370° C.

A first drawback of these techniques is the prohibitive cost of the additives used.

Another major drawback is the necessity to provide a supplementary device for introduction of the additive.

A further drawback of these techniques is that they exhibit an even greater tendency to clogging of the filter and hence the resulting reactions, if the temperatures reached in operation are not sufficiently high, since the additives present in the carbonaceous materials contribute to an even faster fouling of the filter medium.

Other techniques have consisted in experimenting with devices based on supplementary heating means such as burners, electric resistors and others. These supplementary heating means are only used if the cartridge exhibits incipient clogging, reflected by an increase in the pressure drop. Such a regeneration device is put into practice with the engine running, that is, in the presence of a high exhaust gas flow. Such a device hence requires considerable heating power to simultaneously raise the exhaust gases and the mass of the filter cartridge to the right temperature.

On recent so-called common rail diesel engines, a diesel fuel post-injection technique has been used to increase the temperature of the exhaust gases and thereby significantly oxidize and burn the carbonaceous particles retained on the filter. This direct injection technique, which makes use of electromagnetic injectors, effectively serves to proceed with a new diesel injection into the combustion chamber at the time when the exhaust valve opens and thereby to obtain a homogeneous mixture with the exhaust gases and complete oxidation of this diesel fuel on the oxidation catalyst positioned between the engine outlet and the particulate filter.

Also known are methods for the post-injection of regeneration liquid of the diesel fuel and/or alcohol type, for the regeneration of the filtration means arranged downstream of the combustion catalysts in diesel engine exhaust systems. These methods are described in particular in the following patent applications and patents: U.S. Pat. No. 5,207,990, EP-A-1 158 143, U.S. Pat. No. 6,023,930, JP-A-07 119444 and U.S. Pat. No. 5,522,218.

These known methods have the common feature, on the one hand, of not permitting optimal, safe and economical regeneration of the filtration means, and, on the other, of providing no satisfactory solution to the technical problem of the thermal degradation and coking of the regeneration liquid, particularly as regards diesel fuel, and especially at the level of the nozzles of the injectors belonging to the post-injection means. The post-injectors are thereby rapidly damaged by the heat of the exhaust manifold and are hence neither reliable, nor effective.

In such a technical context, it is the object of the present invention to provide a method for the post-injection of hydrocarbon-, alcohol- and/or reducing-agent-type regeneration liquid (e.g. diesel fuel and/or urea and/or ammoniacal solution) adaptable to all diesel engines, permitting regeneration of a filtration device, which remedies the drawbacks of the various existing techniques, consisting in treating the carbonaceous particles and soot emitted by the diesel engines by increasing, whenever necessary, the temperature of the exhaust gases to obtain the right oxidation temperature.

A further object of the invention is to provide a method for the post-injection of hydrocarbon-, alcohol- and/or reducing-agent-type regeneration liquid (e.g. diesel fuel and/or urea and/or ammoniacal solution), thereby avoiding any risk of accumulation of particulates in the filtration device and hence any risk of uncontrolled regeneration.

A further object of the invention is to provide a method for the post-injection of hydrocarbon-, alcohol- and/or reducing-agent-type regeneration liquid (e.g. diesel fuel and/or urea and/or ammoniacal solution), which is not subject to the technical problem of thermal degradation and coking of the regeneration liquid, particularly as regards diesel fuel, and especially at the level of the nozzles of the injectors belonging to the post-injection means.

A further object of the invention is to provide a method for the post-injection of hydrocarbon-, alcohol- and/or reducing-agent-type regeneration liquid (e.g. diesel fuel and/or urea and/or ammoniacal solution), not causing significant additional consumption of fuel and, in general, not incurring any additional financial cost to the user.

A further object of the invention is to provide a method for the post-injection of hydrocarbon-, alcohol- and/or reducing-agent-type regeneration liquid (e.g. diesel fuel and/or urea and/or ammoniacal solution), that does not reduce the performance of the engine, particularly by pressure drops, because of the backpressure exerted by the exhaust gases on the engine, due to the clogging of the filtration device.

A final object of the invention is to provide a filtration device permitting the putting into practice of the method according to the invention of post-injection of hydrocarbon-, alcohol- and/or reducing-agent-type regeneration liquid (e.g. diesel fuel and/or urea and/or ammoniacal solution).

These objects, among others, are achieved by the present invention which relates, primarily, to a method for the post-injection of a regeneration liquid, particularly for the regeneration of a device for filtering exhaust gases produced by a diesel engine, this method being of the type wherein particulates, after being sent to an oxidation catalyst, are retained on a filtration means of said filtration device.

The method according to the invention is characterized in that the regeneration liquid comprises at least one hydrocarbon and/or at least one reducing agent, and in that this post-injection consists essentially in injecting, upstream of the catalyst, using post-injection means:

on the one hand, the regeneration liquid, and on the other, at least one gaseous fluid, preferably compressed air, this regeneration liquid and this gaseous fluid together forming an aerosol suitable for spraying the regeneration liquid into the exhaust gases and for increasing their temperature, so as to accelerate the oxidation rate of said particulates and thereby contribute to the regeneration of the filtration device.

The method according to the invention serves to obtain a good quality aerosol, the indicator of very good regeneration of the exhaust particulate filter.

In this diesel fuel post-injection method, use is made of a device arranged at the outlet of the diesel engine exhaust gases and upstream of an oxidation catalyst, downstream of which are situated the means for filtration of the carbonaceous particles emitted by a diesel engine. In this method, the particulates retained on a filtration means are burned by the action of the residual oxygen and nitrogen oxides present in the exhaust gases.

According to a preferred arrangement of the invention, the post-injection stream of regeneration liquid and the post-injection stream of gaseous fluid, preferably compressed air, issue from substantially concentric openings.

According to an even more preferred arrangement of the invention, a part of the gaseous fluid, preferably compressed air, passes through the same nozzle as the regeneration liquid, up to the post-injection opening.

To further improve the quality of the post-injection aerosol, it is provided according to the invention that a part of the gaseous fluid be mixed with the regeneration liquid before the post-injection.

One of the advantageous arrangements of the invention to limit the risk of clogging consists in maintaining the flow of gaseous fluid, preferably compressed air, in the post-injection nozzle, after the interruption of the post-injection of the regeneration liquid through this nozzle, and during the time necessary for rinsing said nozzle.

To minimize the problem of coking and thermal degradation, arrangements are made so that the temperature of at least a part of the post-injection means is kept lower than or equal to 120° C., preferably 100° C., while the engine is running.

For this purpose, at least a part of the post-injection means is advantageously kept at a distance from the pipe(s) in which the exhaust gases flow.

Preferably, the regeneration liquid is selected: from the group of hydrocarbons comprising oil refining products (preferably gasoline and diesel), from the group of alcohols (preferably methanol), from the group of reducing agents (preferably urea and ammoniacal solutions), and mixtures thereof.

According to a preferred embodiment of the invention, the method comprises the following essential steps consisting in:

measuring a temperature $\theta_m$ upstream of the oxidation catalyst, comparing $\theta_m$ to a temperature $\theta_r$ corresponding to the temperature at which the combustion of the regeneration liquid, in the presence of the combustion catalyst, is complete, if $\theta_m$ is equal to or greater than $\theta_r$, initiating a post-injection of regeneration liquid.

According to an interesting variant of this preferred embodiment, it is provided:

to measure a pressure $P_m$ upstream of the filtration system by a sensor 3, said pressure $P_m$ reflecting the degree of obstruction of the filtration means 5 by the particulates, to compare said pressure $P_m$ to a reference pressure $P_r$ corresponding to the maximum acceptable degree of obstruction, if $P_m$ is equal to or greater than the pressure $P_r$ and if $\theta_m$ is equal to or greater than $\theta_r$, to initiate the post-injection of diesel.

It is particularly advantageous according to the invention to control the injections of regeneration liquid, using at least one computer, taking account of the temperature $\theta_m$ data and possibly the pressure $P_m$ data, to obtain the temperature increase desired for optimal regeneration of the filtration device.

According to another of its objects, the invention further relates to a device for in particular putting into practice the post-injection method as defined above. This device comprises at least one exhaust pipe, at least one catalyst, and filtration means. It is characterized in that it further comprises:

regeneration liquid supply means, means for supplying pressurized gaseous fluid, preferably compressed air, post-injection means communicating with an exhaust gas exhaust pipe including:

at least one injector preferably electromagnetic, at least one injector-holder, on which said injector is arranged, at least one capillary or nozzle starting from the injector and terminating in at least one exhaust pipe via at least one opening, upstream of the catalyst, at least one line connected to the means for supplying pressurized gaseous fluid, preferably compressed air, and terminating in the exhaust pipe(s), via at least one opening, possibly at least one temperature sensor for measuring $\theta_m$, arranged on the exhaust pipe(s), upstream of the catalyst, possibly at least one pressure sensor for measuring $P_m$ in the exhaust pipe(s) and arranged on said pipe(s) upstream of the catalyst, at least one computer for controlling the post-injection, to which are subjected the regeneration liquid supply means, the means for supplying pressurized gaseous fluid, preferably compressed air, the post-injection means, and the temperature or pressure sensor(s), if any.

According to the remarkable features of the device according to the invention:

the capillary (or nozzle) and the line are concentric and coaxial, like their respective openings, which terminate in the exhaust pipe(s), and the capillary (or nozzle) is contained in the line.

Advantageously, at least a part of the post-injection means, preferably at least the injector, is designed so that it is preferably arranged at a sufficient distance from the exhaust pipe(s) to avoid suffering thermal damage, that is, to remain at a temperature lower than or equal to 120° C., preferably 100° C., while the engine is running.

The post-injection of the hydrocarbon-, alcohol- and/or reducing-agent-type regeneration liquid (e.g. diesel fuel and/or urea and/or ammoniacal solution) is assisted by a pressurized gaseous fluid (for example, compressed air). Thanks to the structure of the capillary (or nozzle) line combination, the injector and its support are located:

geographically at a point distant (for example by 200 mm) from the exhaust pipe, to avoid being subjected to high temperatures, and upstream of the oxidation catalyst.

The exhaust gas filtration means are located downstream of the oxidation (or combustion) catalyst. The catalyst and the filtration means are, in practice, contained in a chamber, which is located in the path of the stream of exhaust gases produced by an engine.

According to a preferred embodiment of the device according to the invention, the means for supplying pressurized gaseous fluid, preferably compressed air, are designed to permit the intake of gaseous fluid at the outlet of the injector, at the head of the capillary or nozzle, so that the pressurized gaseous fluid, preferably compressed air, can flow with the post-injected regeneration liquid in the capillary or nozzle.

According to an advantageous variant of this preferred embodiment, the means for supplying pressurized gaseous fluid, preferably compressed air, comprise a solenoid valve controlling the intake of pressurized gaseous fluid, preferably compressed air, at the outlet of the injector, at the head of the capillary or nozzle, to permit said fluid to flow with the regeneration liquid and, secondarily, to rinse the capillary or nozzle after the end of the post-injection, by maintaining, for some time, a flow of pressurized gaseous fluid, preferably compressed air, in the capillary or nozzle.

According to a further variant of this preferred embodiment, the means for supplying pressurized gaseous fluid, preferably compressed air, and the post-injection means—preferably the injector-holder, are designed so that at least one calibrated orifice is provided for the continuous intake of a flow of pressurized gaseous fluid, preferably compressed air, mixed with the regeneration liquid, at the inlet of the capillary or nozzle, in order to produce an emulsion and further and preferably to perform the rinsing function, by maintaining, for some time after the closure, a flow of said gaseous fluid in the capillary or nozzle.

Advantageously, the regeneration liquid supply means are connected to the feed line of at least one mechanical injection pump of the engine.

The regeneration liquid is preferably selected:

from the group of hydrocarbons comprising oil refining products (preferably gasoline and diesel), from the group of alcohols (preferably methanol), from the group of reducing agents (preferably urea and ammoniacal solutions), and mixtures thereof.

Remarkably, the device according to the invention comprises a temperature sensor and a pressure sensor. Furthermore the computer (or electronic control box), which is connected to the temperature sensor and the pressure sensor, compares the values $\theta_m$ and possibly $P_m$ measured respectively with the reference values $\theta_r$ and possibly $P_r$, and initiates the post-injection of regeneration liquid into the exhaust pipe, via the regeneration liquid supply means, the means for supplying pressurized gaseous fluid, preferably compressed air, and the post-injection means, when the measurements $\theta_m$ and possibly $P_m$ are equal to or higher than the reference values $\theta_r$ and possibly $P_r$.

Advantageously, the temperature sensor and, if any, the pressure sensor, are located substantially at the same level on the exhaust pipe.

In practice and for example, the post-injection is carried out by a conventional electromagnetic injector of the same type as the one used on gasoline engines, this injector being arranged on an injector port at a distance from the exhaust pipe. The hydrocarbon-, alcohol- and/or reducing-agent-type regeneration liquid (e.g. diesel fuel and/or urea and/or ammoniacal solution) issuing from this injector is conveyed via a capillary contained in a line consisting, for example, of a metal tube, to the hot exhaust pipe. This tube is supplied with compressed air so as to arrive concentrically around the capillary to flow into the exhaust pipe and cause proper spraying of the hydrocarbon-, alcohol- and/or reducing-agent-type regeneration liquid (e.g. diesel fuel and/or ethanol and/or urea and/or ammoniacal solution). The injection of regeneration liquid and the supply of compressed air are controlled by-the electronic control box, which controls the opening/closure of solenoid valves permitting the post-injection of regeneration liquid into the exhaust gas discharge pipe.

Advantageously, in the injector-holder, a calibrated orifice connected with the air intake and opposite the injector tip is arranged so as to generate a regeneration air/liquid emulsion at the inlet of the capillary and permit the injection of this regeneration liquid in fully atomized form at the outlet, into the discharge pipe.

The present invention will be better understood from a reading of the description that follows, provided with reference to the drawings appended hereto, in a non-limiting manner, of an embodiment of the post-injection device incorporated in a filtration system according to the invention and in which.

Figure 1:
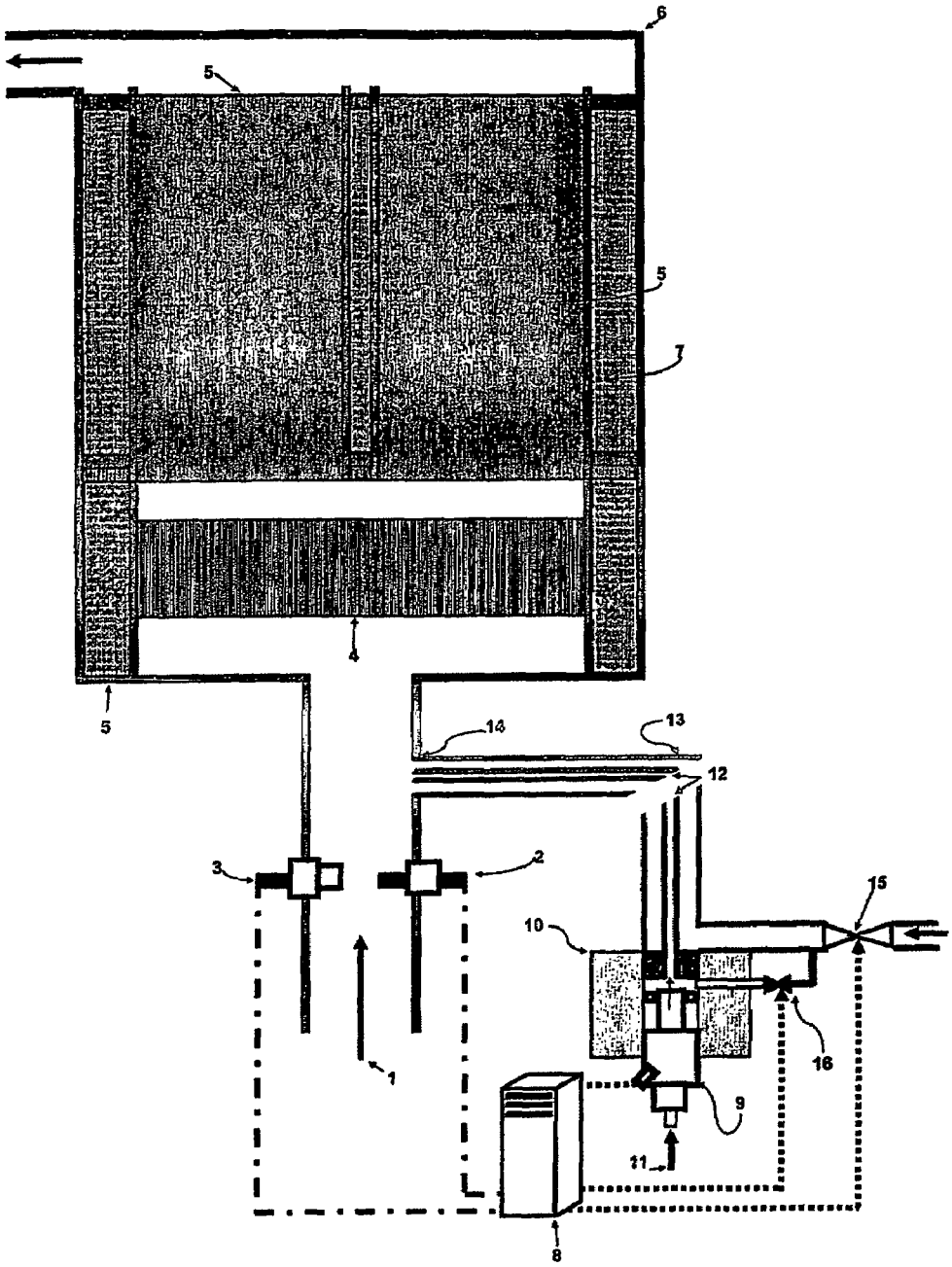
FIG. 1 shows a general schematic view of the system comprising the filtration device with its oxidation catalyst and, upstream of this assembly, the post-injection system for putting the regeneration method into practice.

The system that permits the putting into practice of the regeneration method according to the invention is shown schematically in FIG. 1, according to a preferable embodiment. In this system, various mechanical components of a particulate filter that does or does not form part of the filtration device collaborate in order to permit the control of the regeneration of the filtration system.

Thus the exhaust gases issuing from the diesel engine in the pipe 1, are controlled for temperature by the sensor 2 and for pressure by the sensor 3 and are then sent to the oxidation catalyst 4 and then to the filter cartridges 5, the whole being contained in a metal housing 6 and insulated by ceramic elements 7.

Whenever necessary, a computer 8 actuates the diesel fuel injections from the electromagnetic injector 9 mounted on an injector-holder unit 10, which is supplied from a bypass of the diesel engine via the line 11, the diesel fuel being sent to the exhaust pipe via the capillary 12.

This capillary 12 terminates at the center of the pipe 13 in the exhaust pipe 14 upstream of the oxidation catalyst 4, in order to obtain proper spraying by the air that arrives concentrically and which is admitted by the solenoid valve 15, supplied by a pressure regulator, not shown.

A second solenoid valve 16 serves to purge the capillary to prevent diesel fuel from stagnating in the capillary and from coking and causing its obstruction near the exhaust pipe, which is very hot.

Figure 2:
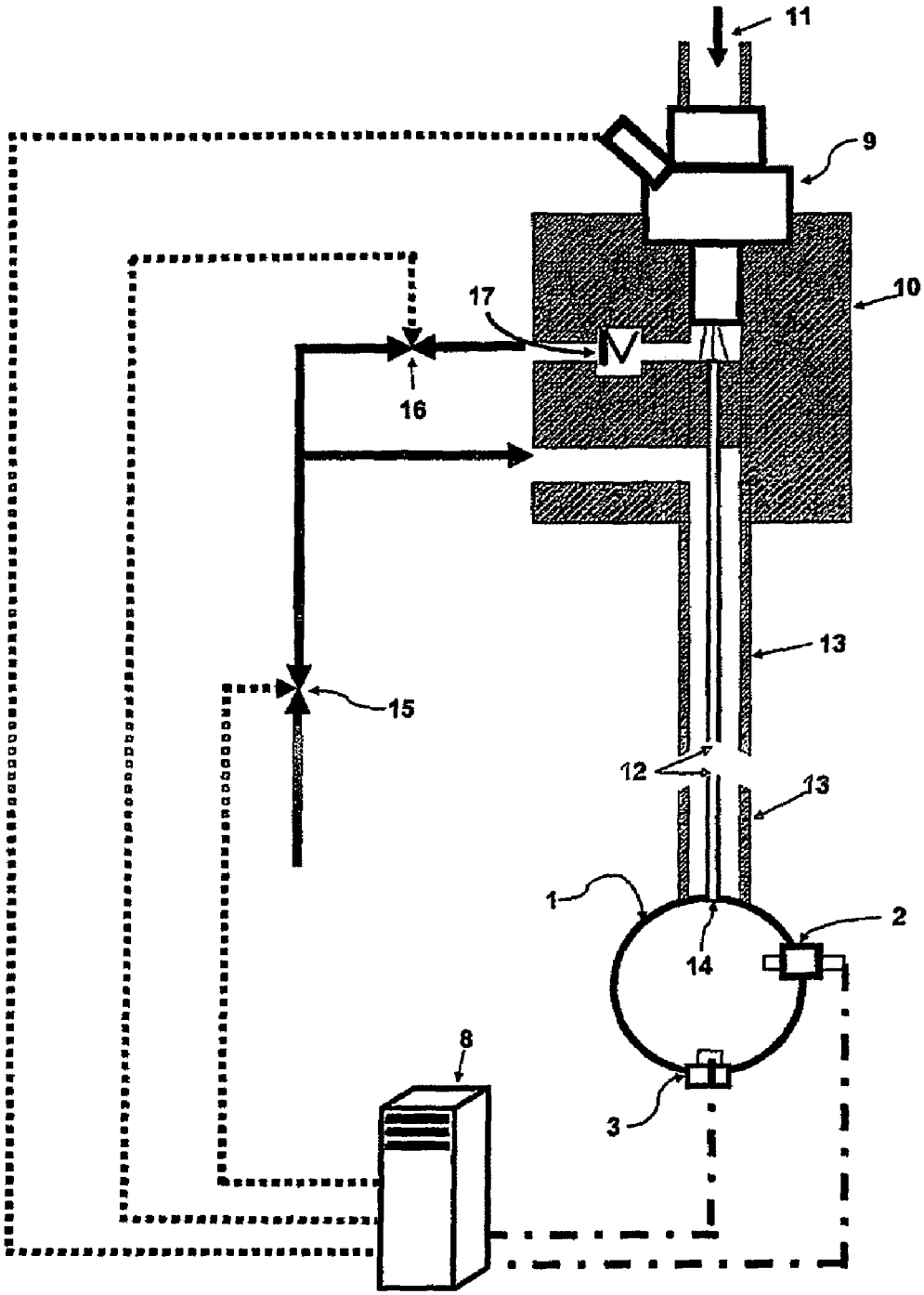
FIG. 2 shows a detailed view of the post-injection device according to a first embodiment.

A detailed view of the post-injection device, particularly of the injector-holder according to a first embodiment, is shown in FIG. 2.

The computer 8, using the temperature and pressure data gathered by the sensors 2 and 3, and depending on the strategy set, actuates a diesel fuel injection from the electromagnetic injector 9 supplied with diesel by the engine circuit at 11. At the outlet of this electromagnetic injector, the volume of diesel injected is sent by the capillary 12 to the exhaust pipe 1 where it is sprayed at 14 with the air that arrives concentrically via the line 13.

The spray air rate is controlled by the solenoid valve 15 supplied by a pressure regulator, not shown, its opening is simultaneous with that of the injector 11, in order to obtain proper spraying from the outset but its closure is delayed by a few seconds in order to allow the rinsing of the capillary by air, which is supplied from the solenoid valve 16 as soon as the injector is closed, a check valve 17 preventing any accumulation of diesel fuel in the line of the injector-holder 10 in order to permit effective rinsing.

Figure 3:
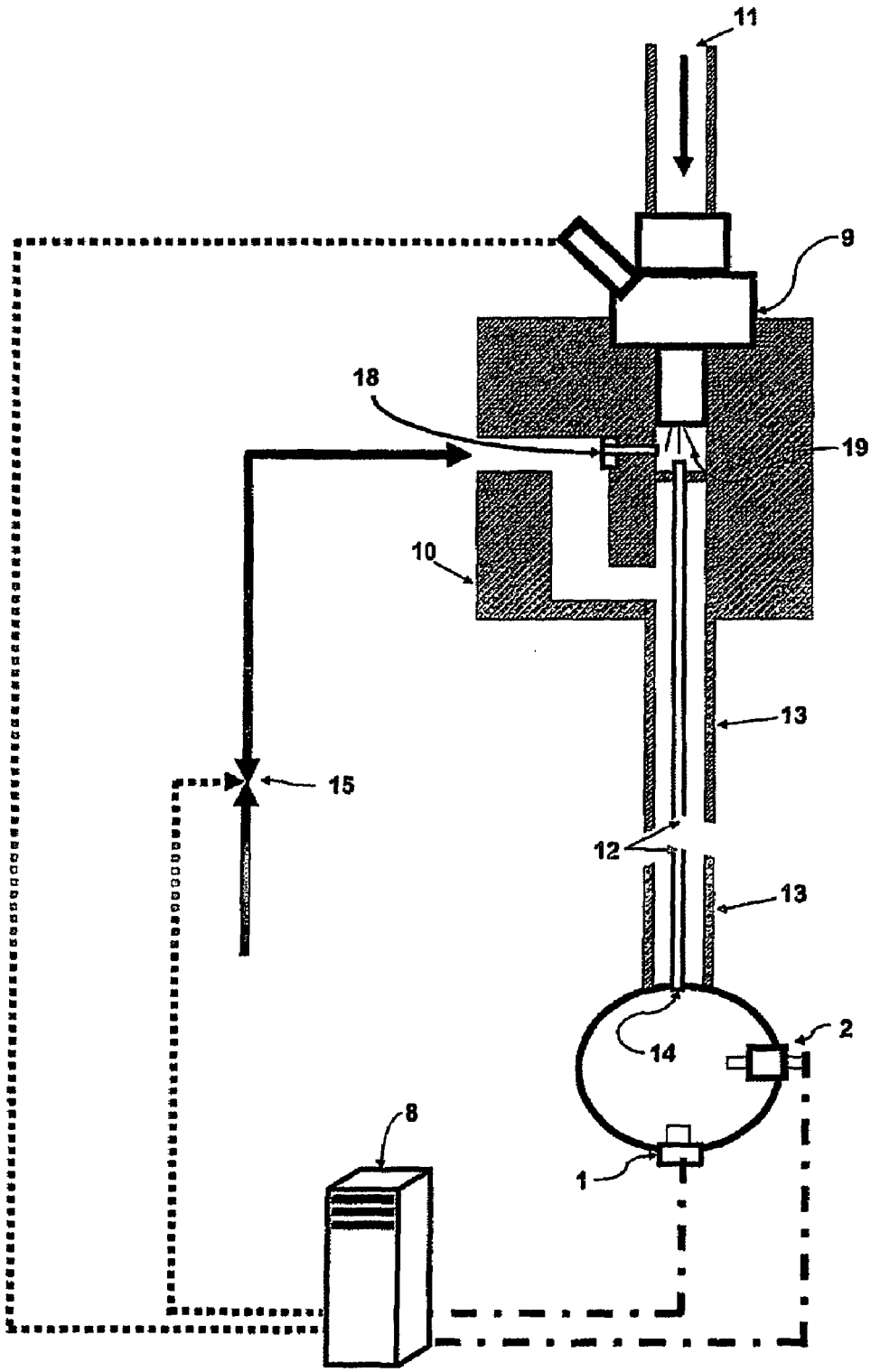
FIG. 3 shows a detailed view of a variant of the post-injection device according to a second embodiment.

A variant of this embodiment is shown in FIG. 3. According to this variant, to improve the quality of spraying of the diesel fuel and to simplify the construction of this assembly, the injector-holder 10 is supplied with air by a single solenoid valve which opens simultaneously with the diesel injector 9, but the closure of which is delayed by a few seconds, as for the previous embodiment, so that the capillary rinsing operation takes place automatically thanks to the air flow controlled by the calibrated air nozzle 18. Further, upon the opening of the solenoid valve 15, this air flow serves to form an emulsion with the diesel fuel issuing from the injector 9 in the chamber 19 and is then sent via the capillary 12 to the outlet into the exhaust pipe at 14. This emulsion terminates at the center of the tube 13 where it encounters the air stream conveyed by this tube, to be finely sprayed and to obtain much better atomization quality, thanks to the emulsion already formed in the capillary. On the closure of the injector, the maintenance of the air flow for a few additional seconds serves to completely rinse the capillary 12.

On this embodiment, good results have been obtained with an air supply pressure of 3 bar, for example, supplied by the solenoid valve 15 via a 4/6 mm rilsan tube, for example, and via a restriction at the inlet of the injector-holder, e.g. 2 mm in diameter and via a 0.45 mm air nozzle, e.g. to supply the chamber 19 at the inlet of the capillary 12. This stainless steel capillary, e.g. of 1/1.6 mm had a length of 50 cm and was contained in a 4/6 mm stainless steel tube, e.g. the quality of the diesel mist obtained-served to carry out injections up to temperatures of 270° C. at the catalyst inlet e.g. without observing undesirable hydrocarbon emissions.

Figure 4:
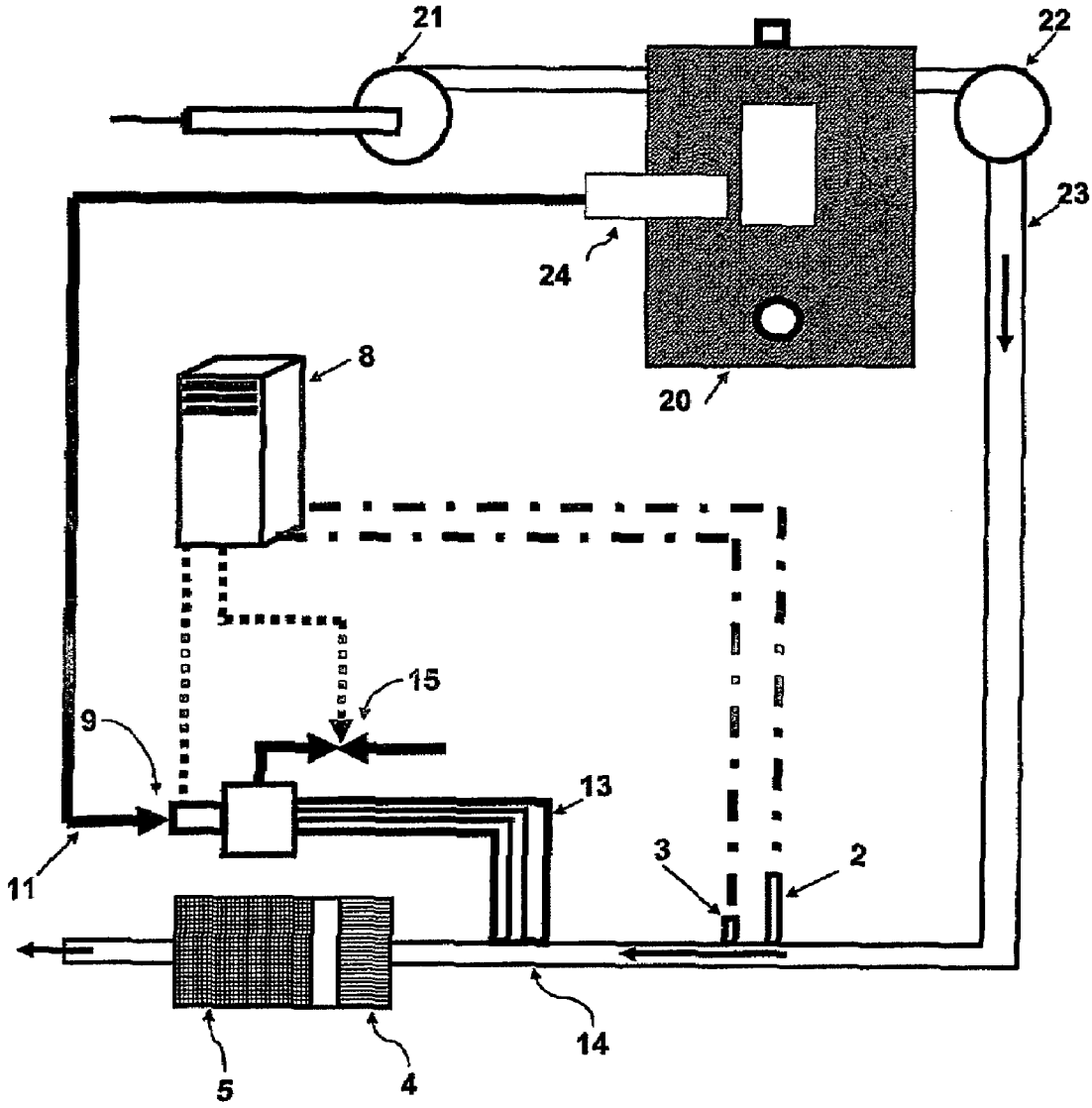
FIG. 4 shows a general view of the post-injection system incorporated in an engine/particulate filter combination.

FIG. 4 shows the post-injection device associated with a particulate filtration system, the combination being mounted on a diesel engine 20 supplied by an air compressor 21, and discharging through a turbine 22 to remove the exhaust gases via a pipe 23, to the system at 1 where the temperature sensor 2 and pressure sensor 3 are arranged, before spraying at 14 the diesel fuel with the air issuing from the line 13. The injector 9 is supplied by a line 11 mounted on a bypass on the diesel feed of the engine injection pump 24.

In the particulate filter regeneration method with the post-injection device, if the temperature is insufficient to initiate the combustion of the particulates, the regeneration occurs thanks to the diesel injection.

For this purpose, the temperature in the neighborhood of the catalyst inlet is measured, using the sensor 2, e.g. of the thermocouple or thermistor type, arranged at the inlet of the system. The value of the temperature $\theta_m$ measured is received by the computer 8. The computer compares this value $\theta_m$ to a reference value $\theta_r$, corresponding to the temperature at which the combustion of the diesel on the catalyst with excess air is complete. A person skilled in the art is perfectly able to determine $\theta_r$. In practice, for diesel engines, $\theta_r$ is for example $\geqq 300°$ C.

If the temperature $\theta_m$ measured is equal to or higher than the reference value $\theta_r$ the electronic control box initiates the opening of the injector 9 and of the solenoid valve 15. This opening causes the intake of diesel fuel into the capillary and compressed air into the tube 13. At the outlet of the tube 13 at 14, the diesel is mixed with the compressed air and the mixture thus formed is sprayed in atomized form into the exhaust gas discharge pipe 1.

The fuel injected into the exhaust pipe 1 enters the chamber 6 and undergoes complete combustion at the catalyst 4. This combustion causes the temperature to rise significantly to a temperature $\theta_c$ at which the combustion of the particulates clogging the filtration means occurs. The molecules of $NO_2$ produced in combination with the excess residual oxygen present in the exhaust gases catalyze this oxidation reaction. Thus this reaction occurs at a temperature lower than the normal combustion temperature.

During this oxidation, the solid particulates are converted to gases which are removed.

The filtration means is then free of deposits and recovers its full filtration capacity.

According to a particular embodiment, the measurement of $\theta_m$ can be used by the electronic control box to evaluate the temperature of the particulates at the level of the filtration means. In fact, if $\theta_m$ is close to the temperature at which combustion of particulates can take place without diesel post-injection, the computer can decide not to initiate this post-injection, thereby achieving a substantial fuel economy.

Another operational mode consists in simultaneously measuring the temperature and pressure at the level of the catalyst production means using the temperature sensor 2 and the pressure sensor 3. The pressure value $P_m$ measured reflects the degree of obstruction of the filtration means by the particulates. In fact, if the filtration means is clogged, the exhaust gases pass through with greater difficulty and exert a backpressure. Thus the measurement of the pressure $P_m$ represents the best means to control the clogging of the filtration means. The sensor 3 is a conventional sensor for measuring the absolute pressure. According to a variant, the pressure sensor 3 may be a sensor for measuring the gauge pressure, comprising one sensor located upstream of the filter and another downstream of said filter.

The electronic control box compares the value $P_m$ measured to a reference value $P_r$, corresponding to the maximum acceptable degree of obstruction of the filtration means. The determination of $P_r$ indicating the clogging is carried out easily and arbitrarily by a person skilled in the art. In practice, and for example, the pressure $P_r$ corresponds to the pressure measured with a new filter plus 100 mbar.

If $P_m$ is equal to or higher than $P_r$, the electronic control box compares $\theta_m$ to $\theta_r$. If $\theta_m$ is equal to or higher than $\theta_r$, the control box initiates the post-injection of diesel which leads to regeneration of the filtration means. This operational mode has the advantage of only initiating post-injection when the filtration means has reached a given degree of clogging, thereby serving to considerably limit the surplus consumption of fuel. With this pressure data, the computer, still based on the setpoints, can, depending on the backpressure level, increase the injection time in order to reach a higher temperature.

EXAMPLE

As a non-limiting example, a filtration device is used with an industrial vehicle engine, the Renault VI 620-45 supercharged engine, with 10 liters cylinder displacement and 180 kW horsepower. This engine is used on urban buses.

The filtration device is composed of:

- a platinum based metal oxidation catalyst permitting total oxidation of CO and hydrocarbons at low temperature, as well as the conversion of part of the NO to $NO_2$, the platinum content was 90 g per cubic foot,
- Ibiden particulate filters, of the silicon carbide honeycomb type, mounted in parallel,
- a diesel injection system according to the second embodiment shown in FIG. 3, the capillary 12 used was made from stainless steel, with 1 mm inside diameter by 1.6 mm outside diameter, and the air intake tube 13 was also made from stainless steel, with 4 mm inside diameter and 6 mm outside diameter, for a total length of 50 cm,
- an electronic control box 8 controlling the diesel post-injection. A timer limits the post-injection time to 20 s and corresponds to an injected quantity of 20 $cm^3$, followed by specific programming of the control box in order to further obtain a post-injection at 7 minute intervals,
- the electromagnetic injector 9 was supplied by the line 11 connected by a tee to the engine injection pump feed line, in order to have a feed pressure of between 1 and 1.5 bar.

The electronic control box was regulated so that the post-injection was initiated as soon as the backpressure reached 150 mb and the gas temperature was higher than 300° C.

In these configurations, the bus traveled more than 45 000 km without observing any drift in backpressure, demonstrating that the post-injection system did its job satisfactorily by permanently maintaining a sufficient temperature for the regeneration of the filter to take place continuously despite the severe service conditions.

A test was conducted after 15 000 km of travel on a pollution cycle representative of urban traffic conditions on the UTAC roller test bench and yielded the following remarkable results:

| TYPE | L/100 | CO2 | CO | HC | NOx | Particulates |
|---|---|---|---|---|---|---|
| Series | 56.7 | 1420 | 4.06 | 1.06 | 23 | 0.43 |
| Devices | 57.6 | 1452 | 0.20 | 0.03 | 21.5 | 0.03 |

Emissions in Grams/Kilometer

These results demonstrate the effectiveness of this device, both in terms of regeneration and pollution control on all pollutants.

The post-injection method according to the invention, associated with a filtration device using an oxidation catalyst, is hence particularly adequate for the treatment of the exhaust gases of urban transit vehicles. In fact, the gases produced by these vehicles are generally produced at a temperature lower than the temperature necessary to permit regeneration of the conventional filtration devices, causing clogging of these devices and hence their rapid deterioration by sudden combustion reactions. However, the results obtained with the present technique served to consider a minimum service life of the filtration device of 100 000 km, on vehicles of this type.

Thus, while the injection device according to the invention does not comprise any novel technical elements, the inventors have the merit of having succeeded in combining and adapting various existing techniques in order to synergize their effects and to obtain a device which is extremely effective and robust for permitting a reliable diesel post-injection generating no undesirable hydrocarbon emissions and permitting a significant increase in the exhaust gas temperature to permit the oxidation of the carbon particulates retained on the filter, and to obtain excellent results in terms of filter regeneration, even in the case of vehicles in which the engine speeds do not permit the production of exhaust gases at high temperature.

The invention claimed is:

1. A device for the post-injection of a regeneration liquid, particularly for the regeneration of a device for filtering exhaust gases produced by a diesel engine, and comprising at least one exhaust pipe, at least one oxidation catalyst and a filtration device for retaining particulates after they have been sent to the oxidation catalyst, said device for the post-injection of a regeneration liquid further comprising:

a regeneration liquid supply device, a device for supplying pressurized gaseous fluid, a post-injection device including:

at least one injector, at least one injector-holder, on which said injector is arranged, at least one capillary starting from the injector and terminating in at least one exhaust pipe via at least one opening, upstream of the catalyst, at least one tube connected to the device for supplying pressurized gaseous fluid, and terminating in the exhaust pipe(s), via at least one opening, the capillary and the tube are concentric and coaxial, like their respective openings which terminate in the exhaust pipe(s), the capillary is contained in the tube, said post-injection device comprising means for injecting, upstream of the catalyst:

on the one hand, the regeneration liquid, and on the other, the pressurized gaseous fluid, this regeneration liquid and this pressurized gaseous fluid together forming an aerosol suitable for spraying the regeneration liquid into the exhaust gases and for increasing their temperature, so as to accelerate the oxidation rate of said particulates and thereby contribute to the regeneration of the filtration device, optionally at least one temperature sensor for measuring $\theta_m$, arranged on the exhaust pipe(s), upstream of the catalyst, optionally at least one pressure sensor for measuring $P_m$ in the exhaust pipe(s) and arranged on said pipe(s) upstream of the catalyst, at least one computer for controlling the post-injection, to which are subjected the regeneration liquid supply device, the device for supplying pressurized gaseous fluid, the post-injection device, and the temperature or pressure sensor(s), if any.

2. The device as claimed in claim 1, wherein the regeneration liquid comprises either at least one hydrocarbon and at least one reducing agent, or at least one hydrocarbon or at least one reducing agent.

3. The device as claimed in claim 1, wherein at least a part of the post-injection device is designed so that it is arranged at a sufficient distance from the exhaust pipe(s) to avoid suffering thermal damage, that is, to remain at a temperature lower than or equal to 120° C. while the engine is running.

4. The device as claimed in claim 1, wherein at least a part of the post-injection device is designed so that is arranged at a sufficient distance from the exhaust pipe(s) to avoid suffering thermal damage, that is, to remain at a temperature lower than or equal to 100° C. while the engine is running.

5. The device as claimed in claim 1, wherein at least the injector is designed so that it is arranged at a sufficient distance from the exhaust pipes(s) to avoid suffering thermal damage, that is, to remain at a temperature lower than or equal to 120° C. while the engine is running.

6. The device as claimed in claim 1, wherein at least the injector is designed so that it is arranged at a sufficient distance from the exhaust pipes(s) to avoid suffering thermal damage, that is, to remain at a temperature lower than or equal to 100° C. while the engine is running.

7. The device as claimed in claim 1, wherein said injector is an electromagnetic injector.

8. The device as claimed in claim 1, wherein the device for supplying pressurized gaseous fluid is designed to permit the intake of gaseous fluid at the outlet of the injector, or at the head of the capillary, so that the pressurized gaseous fluid can flow with the post-injected regeneration liquid in the capillary.

9. The device as claimed in claim 8, wherein the device for supplying pressurized gaseous fluid comprises a solenoid valve controlling the intake of pressurized fluid at the outlet of the injector, or at the head of the capillary, to permit said fluid to flow with the regeneration liquid and, secondarily, to rinse said capillary after the end of the post-injection, by maintaining, for some time, a flow of pressurized gaseous fluid in the capillary.

10. The device as claimed in claim 1, wherein said gaseous fluid is compressed air.

11. The device as claimed in claim 9, wherein said gaseous fluid is compressed air.

12. The device as claimed in claim 1, wherein the device for supplying pressurized gaseous fluid and the post-injection device are designed so that at least one calibrated orifice is provided for the continuous intake of a flow of pressurized gaseous fluid, mixed with the regeneration liquid, at the inlet of the capillary, in order to produce an emulsion and further to perform the rinsing function, by maintaining, for some time after the closure, a flow of said gaseous fluid in the capillary.

13. The device as claimed in claim 12, wherein the device for supplying pressurized gaseous fluid and the injection holder are designed so that at least one calibrated orifice is provided for the continuous intake of a flow of pressurized gaseous fluid mixed with the regeneration liquid, at the inlet of the capillary, in order to produce an emulsion and further to perform the rinsing function, by maintaining, for some time after the closure, a flow of said gaseous fluid in the capillary.

14. The device as claimed in claim 13, wherein said gaseous fluid is compressed air.

15. The device as claimed in claim 1, wherein the regeneration liquid supply device is connected to the feed line of at least one mechanical injection pump of the engine.

16. The device as claimed in claim 1, wherein the regeneration liquid is selected:

from the group of hydrocarbons comprising oil refining products, from the group of alcohols, from the group of reducing agents, and mixtures thereof.

17. The device as claimed in claim 16, wherein:

said hydrocarbons comprising oil refining products are selected from gasoline and diesel;

said alcohol is methanol;

said reducing agents are selected from urea and ammoniacal solutions.

18. The device as claimed in claim 1, further comprising a temperature sensor and a pressure sensor and wherein the computer which is connected to the temperature sensor and to the pressure sensor, is adapted to compare the values $\theta_m$ and optionally $P_m$ measured respectively with the reference values $\theta_r$ and optionally $P_r$, and initiates the post-injection of regeneration liquid into the exhaust pipe, via the regeneration liquid supply device, the device for supplying pressurized gaseous fluid, and the post-injection device, when the measurements $\theta_m$ and optionally $P_m$ are equal to or higher than the reference values $\theta_r$ and optionally $P_r$.

19. A method for the post-injection of a regeneration liquid, particularly for the regeneration of a device for filtering exhaust gases produced by a diesel engine, said method comprising implementing the device according to claim 1 and retaining particulates, after being sent to an oxidation catalyst, on a filtration device, wherein:

the regeneration liquid comprises at least one hydrocarbon and/or at least one reducing agent, the post-injection consists essentially in injecting, upstream of the catalyst, using a post-injection device:

on the one hand, the regeneration liquid, and on the other, at least one gaseous fluid, this regeneration liquid and this gaseous fluid together forming an aerosol suitable for spraying the regeneration liquid into the exhaust gases and for increasing their temperature, so as to accelerate the oxidation rate of said particulates and thereby contribute to the regeneration of the filtration device, wherein the regeneration liquid issuing from an injector is conveyed by a capillary contained in a tube supplied with gaseous fluid; the capillary and the tube are concentric and coaxial, like their respective openings, which terminate in the exhaust pipe(s), and wherein the flow of gaseous fluid is maintained in the post-injection device, after the interruption of the post-injection of the regeneration liquid through this device, and during the time necessary for rinsing said device.

20. The method as claimed in claim 19, wherein a part of the gaseous fluid passes through the same nozzle as the regeneration liquid, up to the post-injection opening.

21. The method as claimed in claim 20, wherein a part of the gaseous fluid is mixed with the regeneration liquid before the post-injection.

22. The method as claimed in claim 19, wherein said gaseous fluid is compressed air.

23. The method as claimed in claim 21, wherein said gaseous fluid is compressed air.

24. The method as claimed in claim 19, wherein the temperature of at least a part of the post-injection device is kept lower than or equal to 120° C., while the engine is running.

25. The method as claimed in claim 24, wherein said temperature is kept lower than or equal to 100° C.

26. The method as claimed in claim 24, wherein at least a part of the post-injection device is kept at a distance from the pipe(s) in which the exhaust gases flow.

27. The method as claimed in claim 19, wherein the regeneration liquid is selected:

from the group of hydrocarbons comprising oil refining products, from the group of alcohols, from the group of reducing agents, and mixtures thereof.

28. The method as claimed in claim 27, wherein said hydrocarbons comprising oil refining products are selected from gasoline and diesel;

said alcohol is methanol;

said reducing agents are selected from urea and ammoniacal solutions.

29. The method as claimed in claim 19, further comprising:

measuring a temperature $\theta_m$ upstream of the oxidation catalyst, comparing $\theta_m$ to a temperature $\theta_r$ corresponding to the temperature at which the combustion of the regeneration liquid, in the presence of the combustion catalyst, is complete, if $\theta_m$ is equal to or greater than $\theta_r$, initiating a post-injection of regeneration liquid.

30. The method as claimed in claim 29, further comprising:

measuring a pressure $P_m$ upstream of the filtration device by a sensor, said pressure $P_m$ reflecting the degree of obstruction of the filtration device by the particulates, comparing said pressure $P_m$ to a reference pressure $P_r$ corresponding to the maximum acceptable degree of obstruction, if $P_m$ is equal to or greater than the pressure $P_r$ and if $\theta_m$ is equal to or greater than $\theta_r$, initiating the post-injection of diesel.

31. The method as claimed in claim 19, wherein the diesel injections are controlled by at least one computer, taking account of the temperature $\theta_m$ data, $\theta_m$ being measured upstream of the oxidation catalyst, and optionally the pressure $P_m$ data, $P_m$ being measured upstream of the filtration device, to obtain the temperature increase desired for optimal regeneration of the filtration device.

* * * * *